US005939145A

United States Patent [19]

Oram

[11] Patent Number: 5,939,145

[45] **Date of Patent: *Aug. 17, 1999**

[54] COATED PIPES AND METHODS OF MAKING THEM

[75] Inventor: Robert Kenneth Oram, Aberdeen, United Kingdom

[73] Assignee: Bredero Price Coaters Limited, Aberdeen, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/624,370

[22] PCT Filed: Oct. 26, 1994

[86] PCT No.: PCT/GB94/02357

§ 371 Date: Apr. 25, 1996

§ 102(e) Date: Apr. 25, 1996

[87] PCT Pub. No.: WO95/11761

PCT Pub. Date: May 4, 1995

[30] Foreign Application Priority Data

Oct. 26, 1993 [GB] United Kingdom ..... 9322008
Oct. 26, 1993 [GB] United Kingdom ..... 9322011

[51] Int. Cl.[6] ..... B05D 1/26; B05D 1/40

[52] U.S. Cl. ..... 427/407.1; 427/409; 427/410; 427/413; 427/231

[58] Field of Search ..... 427/234, 231, 427/237, 239, 407.1, 409, 410, 413

[56] References Cited

U.S. PATENT DOCUMENTS

| | | | |
|---|---|---|---|
| 1,800,896 | 4/1931 | Mitchell et al. . | |
| 3,443,984 | 5/1969 | Stewart . | |
| 3,657,000 | 4/1972 | Kasano et al. | 427/230 |
| 3,687,765 | 8/1972 | MacLean et al. . | |
| 3,797,981 | 3/1974 | Van Dijk | 425/110 |
| 3,876,355 | 4/1975 | Baughmann | 425/113 |
| 3,982,050 | 9/1976 | Kato et al. | 427/233 |
| 4,169,906 | 10/1979 | Hallstrom et al. | 427/183 |
| 4,515,832 | 5/1985 | Roeder et al. | 427/236 |
| 4,608,280 | 8/1986 | Robinson et al. | 427/230 |
| 5,439,711 | 8/1995 | Vu et al. | 425/461 |
| 5,464,886 | 11/1995 | Tran et al. | 523/428 |

FOREIGN PATENT DOCUMENTS

| | | |
|---|---|---|
| 58-122078(A) | 7/1983 | Japan . |
| 913685 | 12/1962 | United Kingdom . |
| 2 018 624 | 10/1979 | United Kingdom . |
| 2 165 772 | 4/1986 | United Kingdom . |
| WO 90/06185 | 6/1990 | WIPO . |

OTHER PUBLICATIONS

Oil & Gas Journal; Polypropylene System Scores High as Pipeline Anti–Corrosion Coating; pp. 42–45; Dec. 14, 1992.

Kunststoffe; Walzen mit Pur–Elastomeren Beschichten; pp. 958–960; 1992.

*Primary Examiner*—Shrive Beck
*Assistant Examiner*—Bret Chen
*Attorney, Agent, or Firm*—Lalos & Keegan

[57] ABSTRACT

A method of coating a pipe comprising the steps of: rotating a pipe to be coated about its longitudinal axis, and applying a coating to the pipe from a dispensing head movable parallel to the axis of rotation of the pipe.

16 Claims, 1 Drawing Sheet

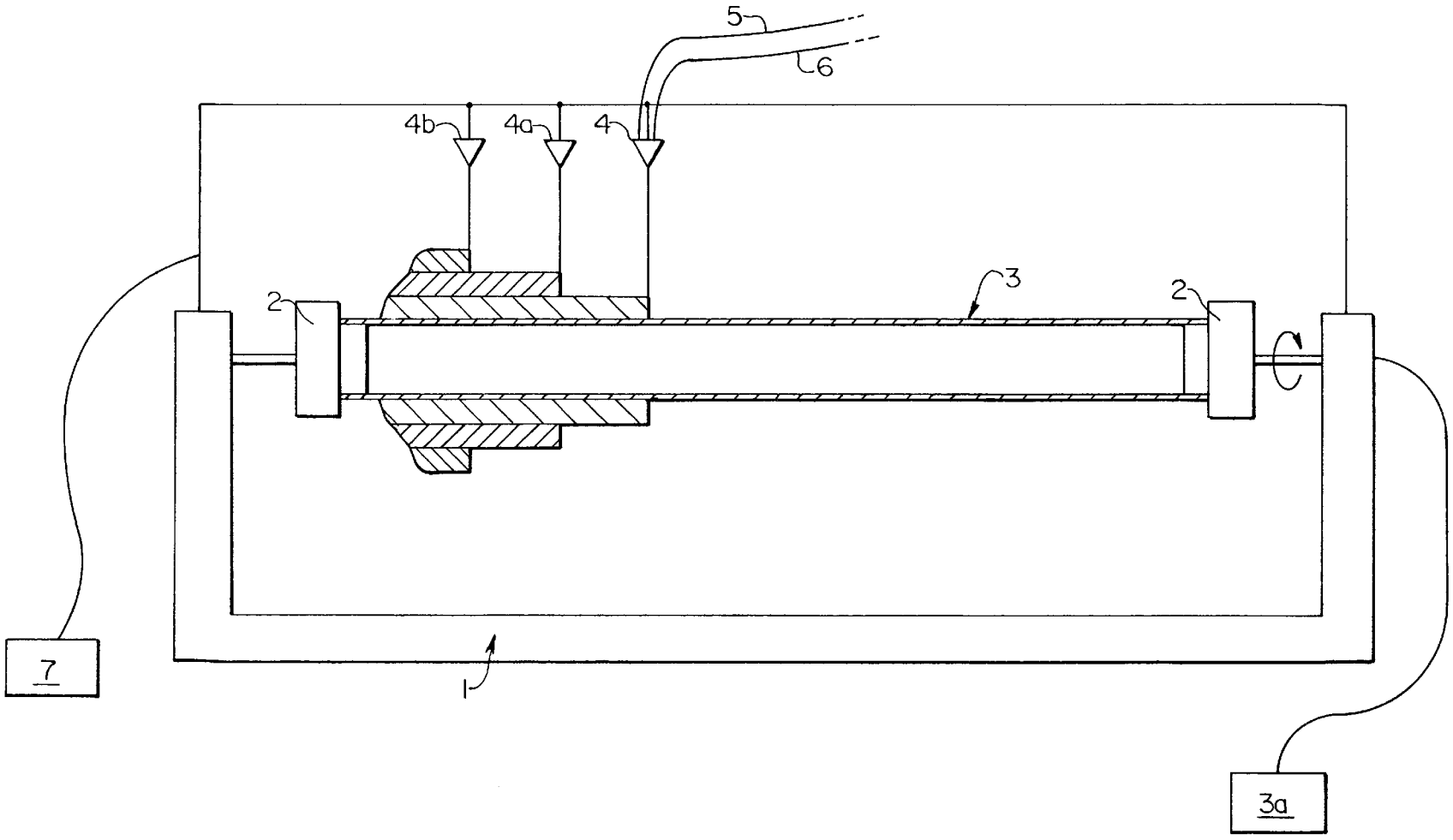
3a
2
3
6
5
4
4a
4b
1
2
7

COATED PIPES AND METHODS OF MAKING THEM

This invention relates to methods of pipe coating, pipes made by the methods, and apparatus for making the pipes.

The invention provides for providing insulating or protective coatings on pipes by pouring or otherwise applying material onto a rotating pipe.

According to the invention there is provided a method of coating a pipe comprising the steps of:

i rotating a pipe to be coated about its longitudinal axis, and ii applying a coating to the pipe from a dispensing head movable relative to the pipe parallel to its axis of rotation.

In some embodiments of the invention the heads are fixed and the bed traverses.

An embodiment of the invention will be illustrated by reference to FIG. 1.

The apparatus comprises a bed 1 provided with chucks 2. The pipe 3 to be coated is mounted in the chucks 2 and caused to rotate. To obtain very high quality product the rate of rotation should be carefully controlled by first controller 3*a*.

Coating is dispensed from head 4. Head 4 is typically air or electrically driven and may traverse along guides. Where the coating is the reaction product of two components they may be supplied by separate feeds 5,6 to the head where they mix and react. Alternatively or additionally they may be mixed prior to supply to the head or they may react on the pipe.

Head 4 is arranged to move parallel to the axis of the pipe 3. The rate of traverse and rate of dispersing are controlled by second controller 7 which may be microprocessor based.

Typically layers up to about 20–25 mm can be routinely dispensed. Further layers can be applied from further heads 4*a*,4*b* traversing behind head 4. Multiple layers can readily be applied in this manner with extremely good inter-layer adhesion being achieved. The further heads may apply the same or different material to the pipe. Four layers can be routinely applied in a single pass. The further heads need not wait for the first head to complete its traverse before applying their coating. Where the heads are fixed and the bed traverses it then the heads generally make a single pass. One or more heads in some embodiments make multiple traverses.

The coating is allowed to cure to a handleable condition and then removed from the apparatus. The coated pipe may have a central coated portion and bare ends. The ends are thus free of the poured coating ready for joining, for example using currently available field joint systems or as described in copending UK application number 93 24 147.9.

A wide range of coatings can be applied.

For example a conventional steel pipe may be coated with an anticorrosion coating of fusion bonded epoxy (FBE) or rubber. These layers may be applied in conventional manner for example spraying or extrusion. Application of epoxy primer in liquid form is a preferred pretreatment. Syntactic polyurethane (PU) can then be applied. Multiple layers of total thickness up to 60 mm giving a U-value of less than 2.5 $Wm^{-2}K^{-1}$ can readily be applied. This system has been tested on pipes up to (16 inch) 0.4 m diameter to give a very satisfactory product substantially free of voids and consistent throughout the thickness.

Table 1 compares the properties of a syntactic PU applied in accordance with the invention with product moulded in a traditional way.

TABLE 1

| | Invention | Control |
|---|---|---|
| Density | 700–760 $kgm^{-3}$ | 700–760 $kgm^{-3}$ |
| Hardness | 80 Shore A | 90 Shore A |
| Tensile Strength | 5.5 MPa | 6.5 MPa |
| Compressive Modulus | 1.5 MPa | 2.0 MPa |
| Elongation at Break | 100% | 60% |
| Abrasion Resistance | 1300 $mm^3$ | 1300 $mm^3$ |

Thus it will be noted that the properties of the product of the invention are very satisfactory with notably good elongation at breaking. Additionally traditional coating of thick layer syntactic foam on large diameter pipe can lead to a poor quality, low density product due to thermal expansion of the polymer spheres in what is known as a "free rise situation". The process of the invention has a marked decrease in the probability of this problem.

The process of the invention is also cost effective. Typically the process of the invention is 5–15% cheaper than traditional methods. Savings occur in a number of areas. Losses in mould-filling amount to about 5–20% in the prior art processes. This is substantially eliminated in the invention. Typically to ensure the prior art processes provide product meeting the contracted specification the pipe is provided with about 2 mm "extra" coating. Because the process of the invention is so controllable this excess can be reduced saving a further 4–10% of coating material.

Labour costs are also reduced. The labour required to apply and cure the coating is reduced by 75%. Since there is no mould the labour required for demoulding and cleaning the mould is eliminated. A labour cost reduction of 10–20% may be anticipated.

Overall a cost reduction of 5–15% can typically be achieved. Although the equipment is expensive, overall the process is not capital intensive since a wide range of product can be produced using the plant.

Conventional moulded foams tends to have an axial and/or radial density gradient due to differential rising of the blown foam. The invention substantially reduces this gradient.

Possible coatings include low density rigid PU foam. This is very suitable for use in shallow waters land approaches and on-shore installations. It may be applied aver FBE and can have a density of 80–200 $Kgm^{-3}$. At a thickness of 75 mm the product has a U-value of less than 0.5 $Wm^{-2}k^{-1}$.

Urethane-modified polyisocyanurate foams (PIR) can be applied in bulk densities typically 80–450 $kgm^{-3}$ (i.e. suitable for depths up to 250 m). They may be applied as thermal insulation on top of primers and/or anticorrosion coatings. PIR is thermally stable and may be used at 140° C. in contrast with PU foams which have a maximum service temperature of no greater than 110° C.

Polyurea elastomer can be applied. This material is stable at very high temperatures (in excess of 160° C.). The polyurea may be applied to steel or a primed surface as an anticorrosion layer. If desired further layers for example of foam insulant may be applied over the polyurea.

High Density Rigid Polyurethane Foam can also be applied using the invention typically to pipes having FBE or rubber base coats. The system has been satisfactorily tried on (16 inch) 0.4 m diameter pipe with coating up to 50 mm thick. Typical bulk densities range from 250 $kgm^{-3}$ (suitable for use at 150 m at 75° C.) to 450 $kgm^{-3}$ (suitable for use at 250 m at the same temperature).

Table 2 compares the product of the invention with prior art products.

TABLE 2

| | Invention | Control |
|---|---|---|
| Density | 450 $kgm^{-3}$ | 450 $kgm^{-3}$ |
| Tensile Strength | 5.0 MPa | — |
| Elongation at Break | 5% | 1–3% |
| Compressive Modulus | 15 MPa | 10–12 MPa |

It may be used as a stand alone coating or may be overcoated for example with solid PU elastomer water barrier coatings. Typical coating thickness 3 mm or greater.

The following coatings may be applied alone or in combination with others.

A high mechanical strength coating may be adopted having say a hardness of 95 Shore A tensile strength of 40 MPa elongation at break of 350% and abrasion resistance 100 $mm^3$.

A coal tar/urethane coating typically applied in layers of 3 mm or greater may be applied and may for example protect FBE from rock dumping and minor impacts. Typical properties are hardness of 85 Shore A tensile strength of 20 MPa, elongation at break of 300% and abrasion resistance 350 $mm^3$.

Solid PU or other nonfoamed materials may be applied for example as an outer jacket over foamed coatings. This fully encapsulates the foam and substantially reduces water penetration and provides impact protection. Solid i.e. nonfoamed PU may also be applied as an impact crack arrestor for example under a syntactic PU or PU foam/solid PUjacket. Solid PU may also be applied to primed steel or FBE. Table 3 compares the properties of solid PU applied in accordance with the invention with that moulded according to prior art processes.

TABLE 3

| | Invention | Control |
|---|---|---|
| Hardness | 90 Shore A | 90 Shore A |
| Tensile Strength | 15 MPa | 15 MPa |
| Elongation at break | 250% | 300% |
| Abrasion resistance | 110 $mm^3$ | 110 $mm^3$ |

Other coatings include pressure resistant syntactic PU usable to 450 m at 110° C. and processible through standard PU equipment and PU elastomeric weight coatings for minor adjustments of submerged weight. Thin layers of say up to 5 mm may be applied and can be laid from a reel ship.

The process of the invention is desirable on environmental grounds due to the reduction in spillage and wastage and exposure of personnel to coating materials.

The invention is also very flexible as short joints, interrupted coatings, taper or stepped transition joints can be produced. Since there is no mould changes in thermal design can be readily accommodated by changing the commands issued to the heads.

I claim:

1. A method of applying a coating to the outside of a pipe having ends, for subsea use comprising:

applying an anti-corrosive unmolded coating layer to said pipe;

rotating the pipe about its longitudinal axis;

pouring a polymer on said pipe to form an unmolded coating layer by relative movement between said pipe and a polymer dispensing head remote from said pipe along a line parallel to the longitudinal axis of the rotating pipe;

pouring successively additional unmolded coating layers of polymer over said coating layer by relative movement between said pipe and a polymer dispensing head remote from said pipe along a line parallel to the longitudinal axis of the rotating pipe;

wherein one polymer coating layer is a foam layer; and wherein said polymer coating layers extend up to a point proximate to the ends of said pipe.

2. The method of claim 1, wherein the foam has a bulk density in the range 80 to 450 $kgm^{-3}$.

3. The method of claim 1, wherein the pipe is a steel pipe.

4. The method of claim 1, wherein the coating layer is a tapered coating.

5. The method of claim 1, wherein the coating layer is an interrupted coating.

6. The method of claim 1, wherein the coating layer is 5 to 75 mm thick.

7. The method of claim 6, wherein the coating layer is 25 to 75 mm thick.

8. A method of coating pipe as in claim 1 wherein said pipe is movable horizontally along its longitudinal axis and said polymer dispensing heads are fixed.

9. The method of claim 1 including, a first coating layer being an anticorrosion layer selected from the group consisting of fusion bonded epoxy and rubber.

10. The method of claim 1 including, moving a dispensing head parallel to the longitudinal axis of the pipe and pouring a first coating layer of curable polyurethane onto the anticorrosion coating layer.

11. The method of claim 1 including, prior to curing one of the coating layers moving a dispensing head parallel to the longitudinal axis of the pipe and pouring a second coating layer of curable polyurethane to the first coating layer.

12. The method of claim 1 including, said polymer being selected from the group consisting of polyurethane, urethane-modified polyisocyanurate foam and polyurec elastomer.

13. The method of claim 1 including, one of said additional unmolded coating layers being formed by moving a different dispensing head parallel to the longitudinal axis of the rotating pipe and pouring said coating layer prior to the curing of a prior coating layer.

14. A method of applying a coating to an outside of a pipe having ends and a longitudinal axis for subsea use, the method comprising the steps of:

applying an anticorrosion unmolded coating layer selected from the group consisting of fusion bonded epoxy and rubber to the outside of the pipe;

rotating the pipe about its longitudinal axis;

moving a first dispensing head parallel to the longitudinal axis of the pipe and pouring a first coating layer of curable polyurethane to the anticorrosion layer leaving the pipe ends uncovered with polyurethane;

moving a second dispensing head parallel to the longitudinal axis of the pipe relative to the pipe and pouring a second coating layer of curable polyurethane on top of the first coating layer.

15. The method of claim 14 including, said anticorrosion coating layer is selected from the group consisting of fusion bonded epoxy and rubber.

16. The method of claim 14 including, said second coating layer being applied prior to the curing of said first coating layer.

* * * * *